US011278123B2

(12) United States Patent
Choi

(10) Patent No.: US 11,278,123 B2
(45) Date of Patent: Mar. 22, 2022

(54) BED STRUCTURE

(71) Applicant: Inno-Sports Co., Ltd, Xiamen (CN)

(72) Inventor: Kwan Jun Choi, Xiamen (CN)

(73) Assignee: Inno-Sports Co., Ltd, Xiamen (CN)

( * ) Notice: Subject to any disclaimer, the term of this patent is extended or adjusted under 35 U.S.C. 154(b) by 63 days.

(21) Appl. No.: 16/891,098

(22) Filed: Jun. 3, 2020

(65) Prior Publication Data

US 2020/0375368 A1 Dec. 3, 2020

(30) Foreign Application Priority Data

Jun. 3, 2019 (CN) ..... 201920827425.8

(51) Int. Cl.
*A47C 19/12* (2006.01)
*A47C 20/04* (2006.01)

(52) U.S. Cl.
CPC ..... *A47C 19/12* (2013.01); *A47C 20/04* (2013.01)

(58) Field of Classification Search
CPC ..... A47C 19/12; A47C 20/04; A47C 20/041; A47C 19/122; Y10T 403/32336; Y10T 403/32361; Y10T 403/32393
USPC ..... 5/618
See application file for complete search history.

(56) References Cited

U.S. PATENT DOCUMENTS 893,364 A * 7/1908 Piaser ..... A47C 17/48 5/149
1,659,941 A * 2/1928 Cable ..... A47C 19/122 5/310
2,281,209 A * 4/1942 Orville ..... A61G 7/16 5/618
3,065,344 A * 11/1962 Chervenka ..... A61G 13/10 378/177
3,211,495 A * 10/1965 Peter ..... A47C 20/043 297/68
6,336,234 B1 * 1/2002 Kuo ..... A47D 13/063 5/93.1
7,552,487 B2 * 6/2009 Chen ..... A47D 13/063 248/292.12
8,370,973 B1 * 2/2013 Oh ..... A47C 23/005 5/250
10,986,932 B2 * 4/2021 Wang ..... A47C 19/122
2015/0143630 A1 * 5/2015 Harrow ..... A47C 19/12 5/400
2016/0316923 A1 * 11/2016 Choi ..... A47C 19/024
2017/0325592 A1 * 11/2017 Suh ..... A47C 20/041

* cited by examiner

*Primary Examiner* — David R Hare
*Assistant Examiner* — Luke Hall
(74) *Attorney, Agent, or Firm* — Bayramoglu Law Offices LLC

(57) ABSTRACT

A bed structure includes a bedstead formed by bedstead units. The bedstead units are symmetrically arranged with respect to the central axis of the bedstead. The bedstead unit includes a first bedstead unit and a second bedstead unit. The first bedstead unit is hinged to the second bedstead unit. A motor is provided between the first bedstead unit and the second bedstead unit. The bedstead units at both sides of the central axis of the bedstead are hinged by a fixing rod. Each of two ends of the fixing rod is provided with a clamping member. The bedstead unit is provided with a matching member connected to the clamping member. The clamping member and the matching member are hinged by a fastener. In this arrangement, the electric bed can be folded.

8 Claims, 9 Drawing Sheets

BED STRUCTURE

CROSS REFERENCE TO THE RELATED APPLICATIONS

This application is based upon and claims priority to Chinese Patent Application No. 201920827425.8, filed on Jun. 3, 2019, the entire contents of which are incorporated herein by reference.

TECHNICAL FIELD

The present invention relates to furniture, and more particularly, to a folding bed structure.

BACKGROUND

Many cannot afford large houses due to increasing costs of housing in large and medium-sized cities. There are only a few bedrooms in a house, and even no private bedrooms. In this regard, efficient space utilization inside the home or building structure is of urgent concern. Traditional beds used in bedrooms are generally arranged horizontally on the ground and cannot be folded electrically. As a result, the bedroom space is largely occupied and cannot be fully utilized during the day.

SUMMARY

To solve the above-mentioned technical problems, an objective of the present invention is to provide a bed structure. Specifically, the bedstead is folded by a motor.

The present invention is realized by the following technical solutions:

A bed structure includes a bedstead formed by bedstead units. The bedstead units are symmetrically arranged with respect to the central axis of the bedstead. The bedstead unit includes a first bedstead unit and a second bedstead unit. The first bedstead unit is hinged to the second bedstead unit. A motor is provided between the first bedstead unit and the second bedstead unit. The bedstead units at both sides of the central axis of the bedstead are hinged by a fixing rod.

In an embodiment of the present invention, each of the two ends of the fixing rod is provided with a clamping member. The bedstead unit is provided with a matching member connected to the clamping member. The clamping member and the matching member are hinged by a fastener.

In an embodiment of the present invention, the bedstead unit includes a support frame and a bed board. The bed board of the second bedstead unit is fixedly connected to the support frame, and the matching member is arranged on the support frame.

In an embodiment of the present invention, the clamping member is provided with a positioning column. The matching member is provided with an arc-shaped groove matched with the positioning column. The arc-shaped groove includes a first notch and a second notch. An arc-shaped protrusion is provided between the first notch and the second notch.

In an embodiment of the present invention, a side end surface of the first notch is vertical. The side end surface of the second notch and the matching surface of the second notch are straight surfaces.

In an embodiment of the present invention, the bed board includes outer frames and a support bar arranged between the outer frames.

In an embodiment of the present invention, the support frame is provided with a first fixing member that is fixed to the outer frame of the second bedstead unit.

In an embodiment of the present invention, the support frame is provided with a second fixing member that is fixed to the support bar of the second bedstead unit.

In an embodiment of the present invention, a fixed connecting rod is provided between the support frame and the first bedstead unit.

In an embodiment of the present invention, latticed support columns are provided on the bed board.

The bed structure of the present invention has the following advantages:

1. The bedstead units are hinged to each other by the fixing rod to form a foldable structure. Besides, the arc-shaped groove and the positioning column are arranged so that the bedstead units at both sides of the fixing rod can be seamlessly connected when folded.

2. The bedstead includes the support frame and the bed board. A space for receiving the motor is reserved under the bed board and the support frame, which make the structure compact and rational. The bed board can be lifted or lowered by the motor, which is convenient for users to adjust the tilt structure of the bed under different activities with ease.

3. The bed board is formed by integrating the outer frames, the support bar, and the support columns, thereby simplifying the laborious disassembly and assembly process and facilitating the folding process.

BRIEF DESCRIPTION OF THE DRAWINGS

In order to explain the technical solutions of the present invention more clearly, the drawings used in the embodiments or the description of the prior art will be briefly introduced hereinafter. Obviously, the drawings in the following description are only some embodiments of the present invention, and those having ordinary skill in the art can obtain other drawings based on these drawings without creative efforts.

In the figures: 10-bedstead unit; 11-first bedstead unit; 12-second bedstead unit; 13-support frame; 14-bed board; 15-outer frame; 16-support bar; 17-support column; 20-motor; 30-fixing rod; 31-clamping member; 32-positioning column; 41-first fixing member; 42-second fixing member; 43-fixed connecting rod; 50-matching member; 51-first notch; 52-second notch; 53-arc-shaped protrusion; 55-arc-shaped groove.

DETAILED DESCRIPTION OF THE EMBODIMENTS

The technical solutions in the embodiments of the present invention will be described clearly and completely with reference to the drawings. Obviously, the described embodiments are only a part of the embodiments of the present invention rather than all the embodiments. Based on the embodiments of the present invention, all other embodiments obtained by those having ordinary skill in the art without creative efforts shall fall within the scope of protection of the present invention.

Figure 1:
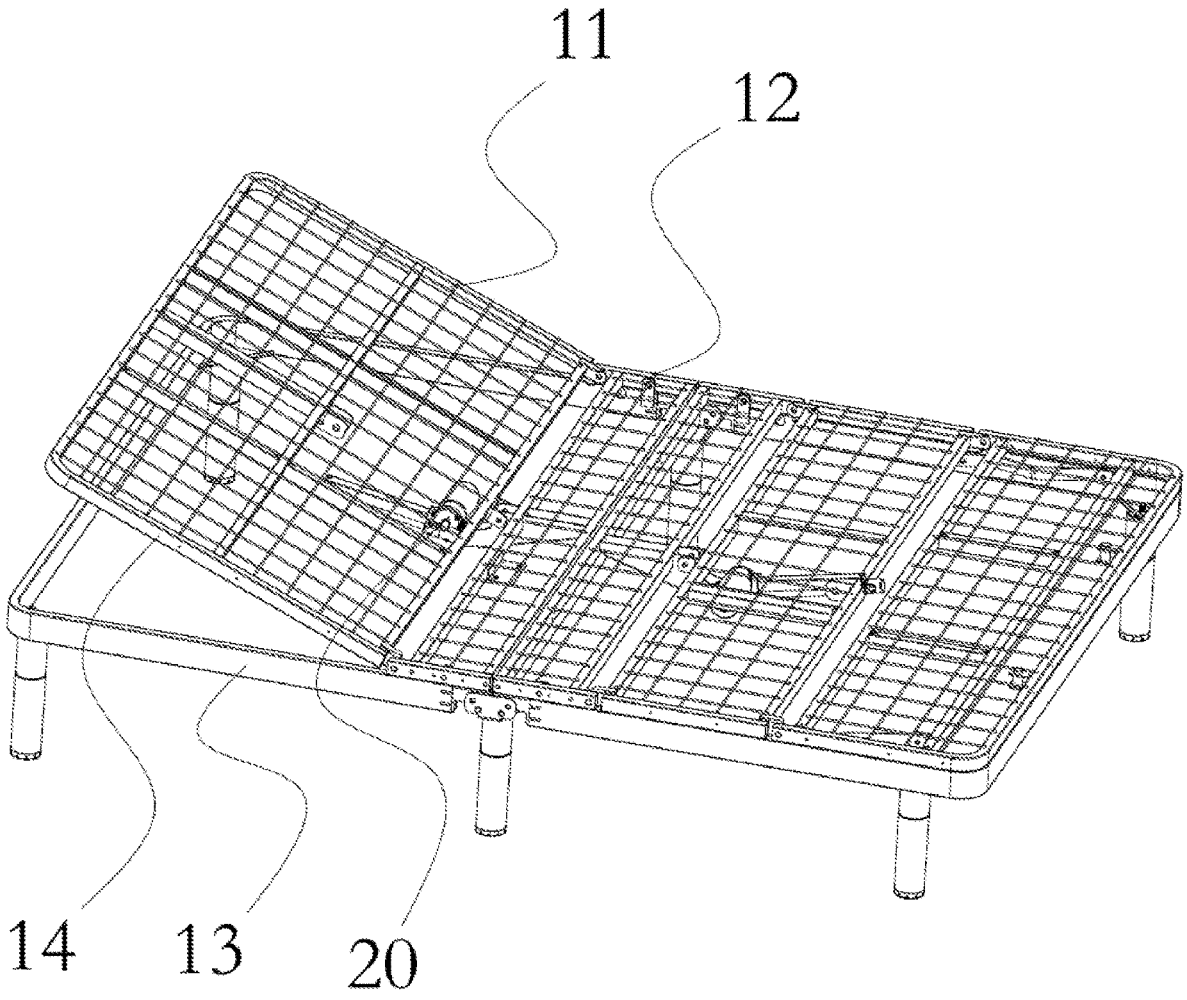
FIG. 1 is a perspective view of the present invention.
Figure 2:
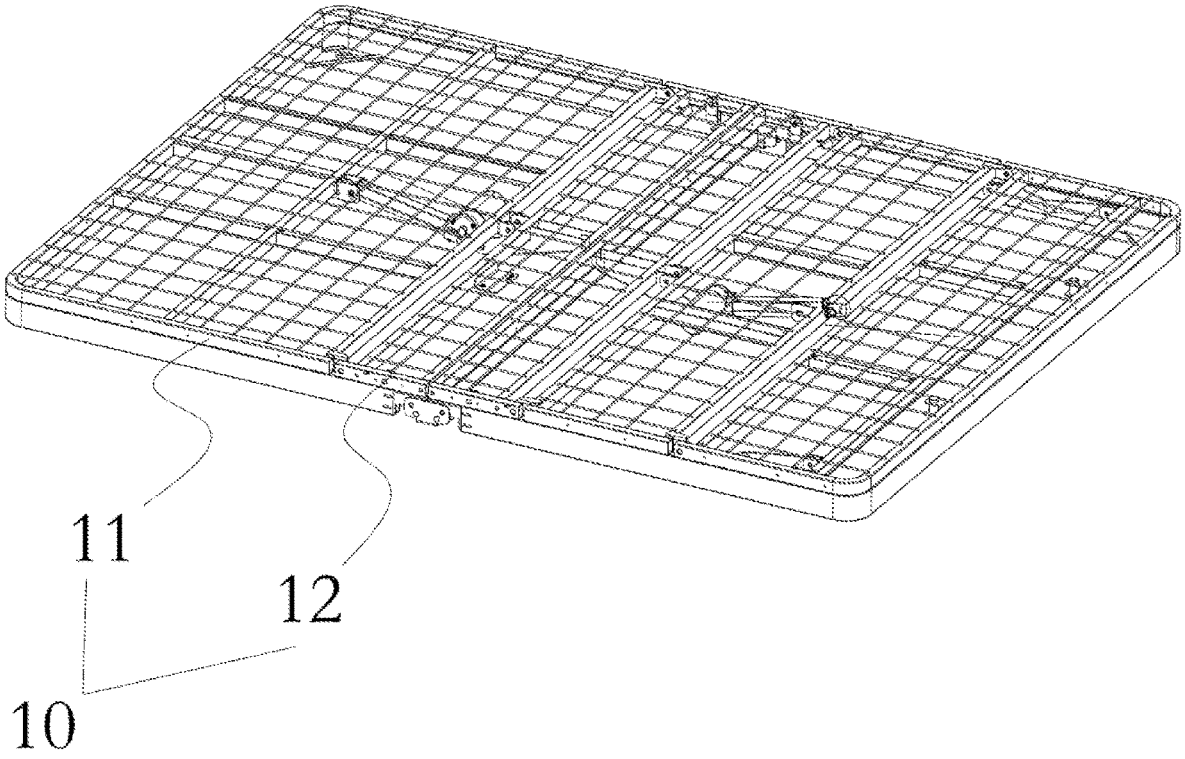
FIG. 2 is a schematic diagram showing the present invention in use.
Figure 3:
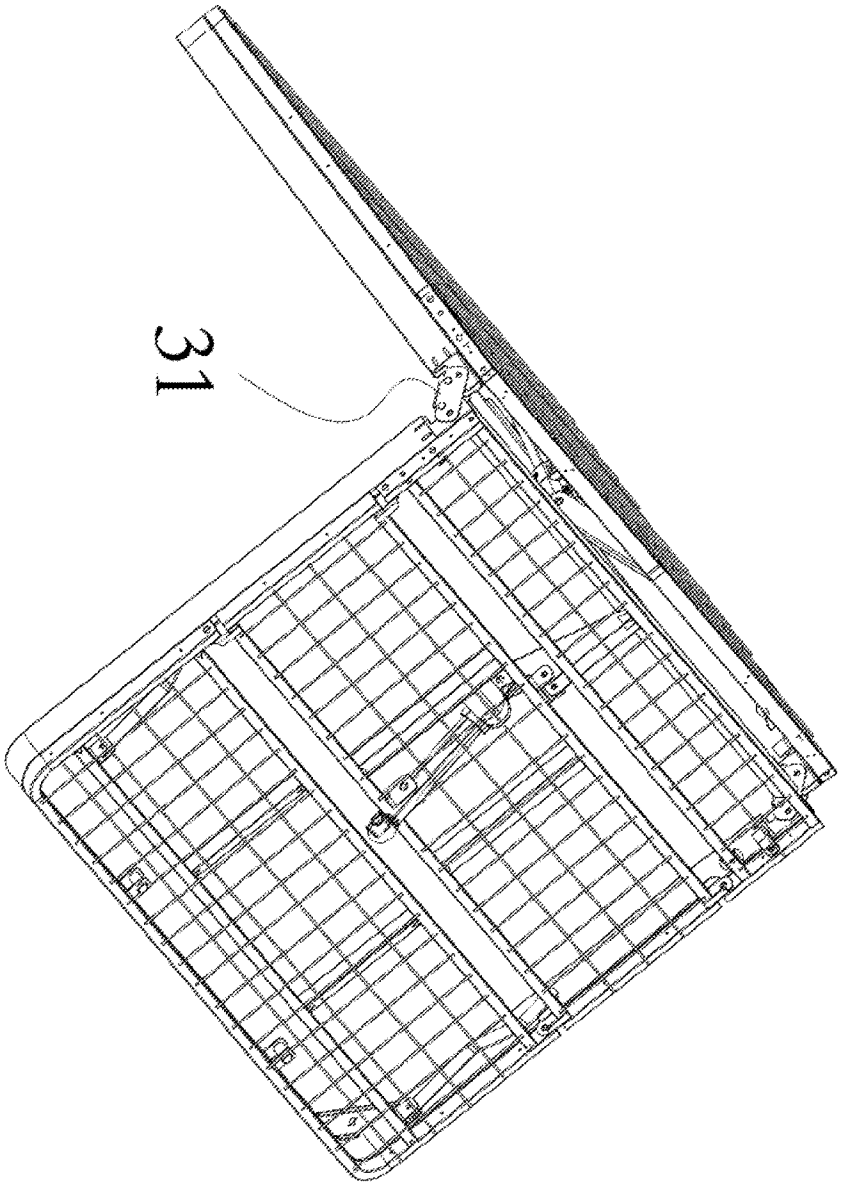
FIG. 3 is a schematic diagram showing the folding process of the present invention.
Figure 4:
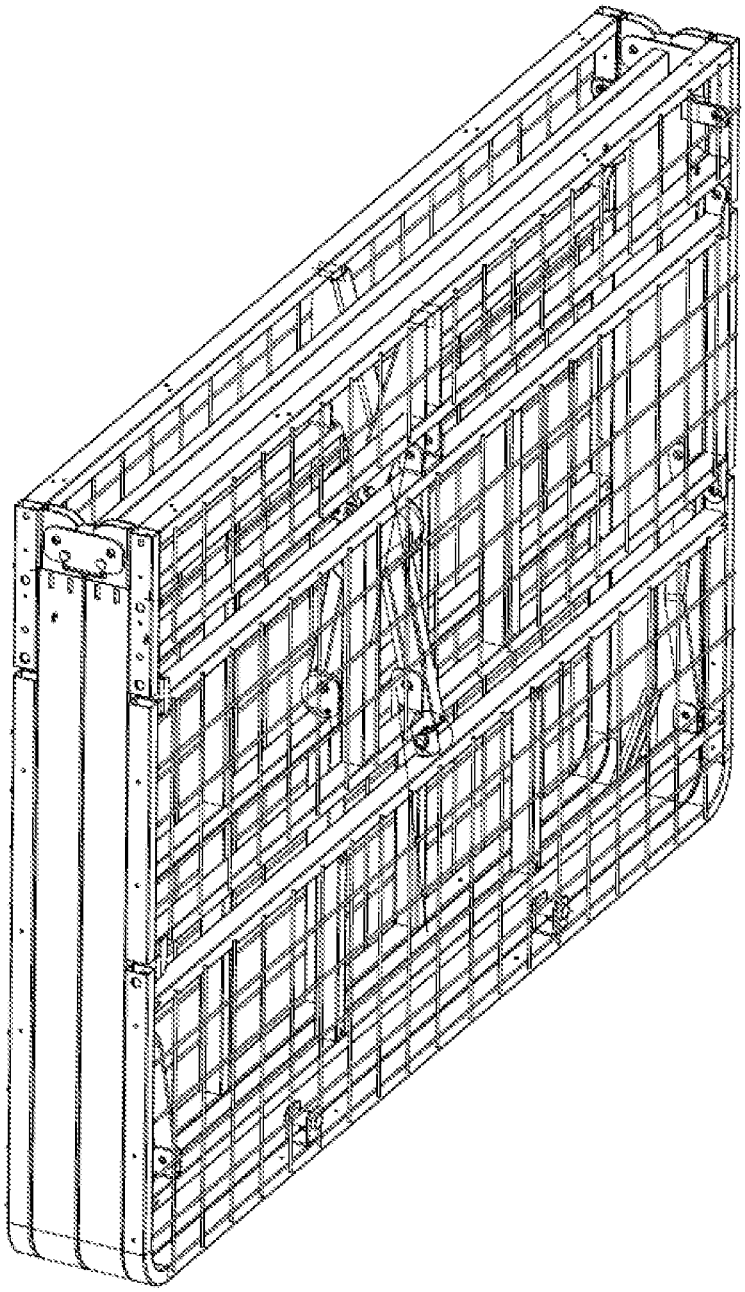
FIG. 4 is a schematic diagram showing the folded state of the present invention.
Figure 5:
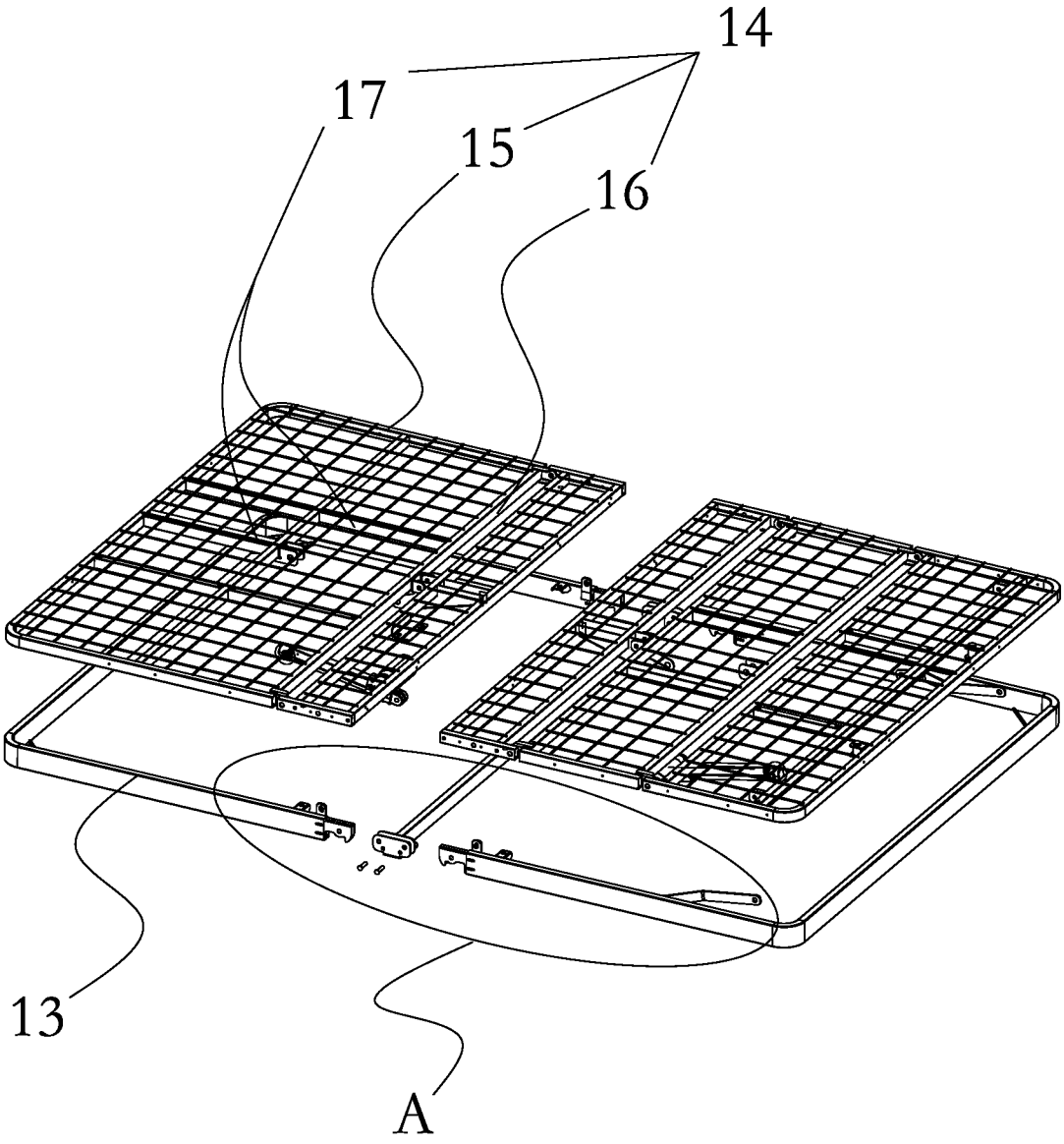
FIG. 5 is an exploded view of the present invention.
Figure 6:
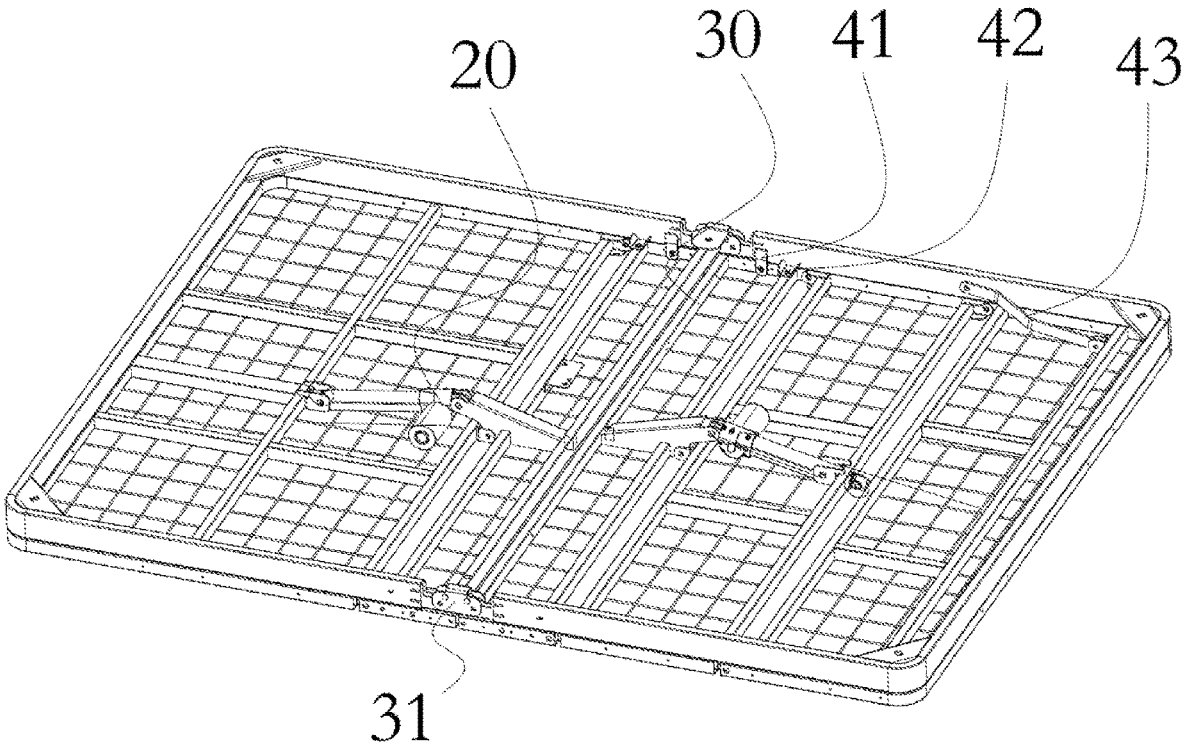
FIG. 6 is a schematic diagram of the present invention.

As shown in FIGS. 1-9, the bed structure includes the bedstead formed by the bedstead units (10). The bedstead units (10) are symmetrically arranged with respect to the central axis of the bedstead. The bedstead unit (10) includes the first bedstead unit (11) and the second bedstead unit (12). The first bedstead unit (11) is hinged to the second bedstead unit (12). The motor (20) is provided between the first bedstead unit (11) and the second bedstead unit (12). The bedstead units (10) at both sides of the central axis of the bedstead are hinged by the fixing rod (30). In this arrangement, the electric bed can be folded around the fixing rod (30) to form a single piece, as shown in FIG. 4. In addition, the first bedstead unit (11) can be tilted around the second bedstead unit (12) under the action of the motor (20) to form an inclined backrest in which users can comfortably sit and lie for reading and other behaviors, as shown in FIG. 1.

Further, the bedstead unit (10) includes the support frame (13) and the bed board (14). The bed board (14) of the second bedstead unit (12) is fixedly connected to the support frame (13). The bed board (14) of the second bedstead unit (12) acts as the fixing member, so that the bed board (14) of the first bedstead unit (11) can be lifted around the hinge point between the first bedstead unit (11) and the second bedstead unit (12) under the action of the motor (20) to form the backrest.

Further, the bed board (14) includes the outer frames (15) and the support bar (16) arranged between the outer frames (15). Specifically, the second bedstead unit (12) is fixed to the support frame (13), wherein, the support frame (13) is provided with the first fixing member (41) that is fixed to the outer frame (15) of the second bedstead unit (12), and the support frame (13) is provided with the second fixing member (42) that is fixed to the support bar (16) of the second bedstead unit (12). The fixed connecting rod (43) is provided between the support frame (13) and the first bedstead unit (11). The support frame (13) is fixed in the longitudinal and horizontal directions to ensure the stable connection between the support frame (13) and the second bedstead unit (12). Moreover, the fixed connecting rod (43) is configured to improve the stability of the rotation between the first bedstead unit (11) and the second bedstead unit (12) and significantly reduce the force applied on the hinge point between the first bedstead unit (11) and the second bedstead unit (12).

Further, the bed board (14) is provided with the latticed support columns (17). The latticed support columns (17) are integrated to form a support surface, avoiding the multiple disassembly and assembly processes. A cotton mattress can be directly placed on the support surface.

Figure 7:
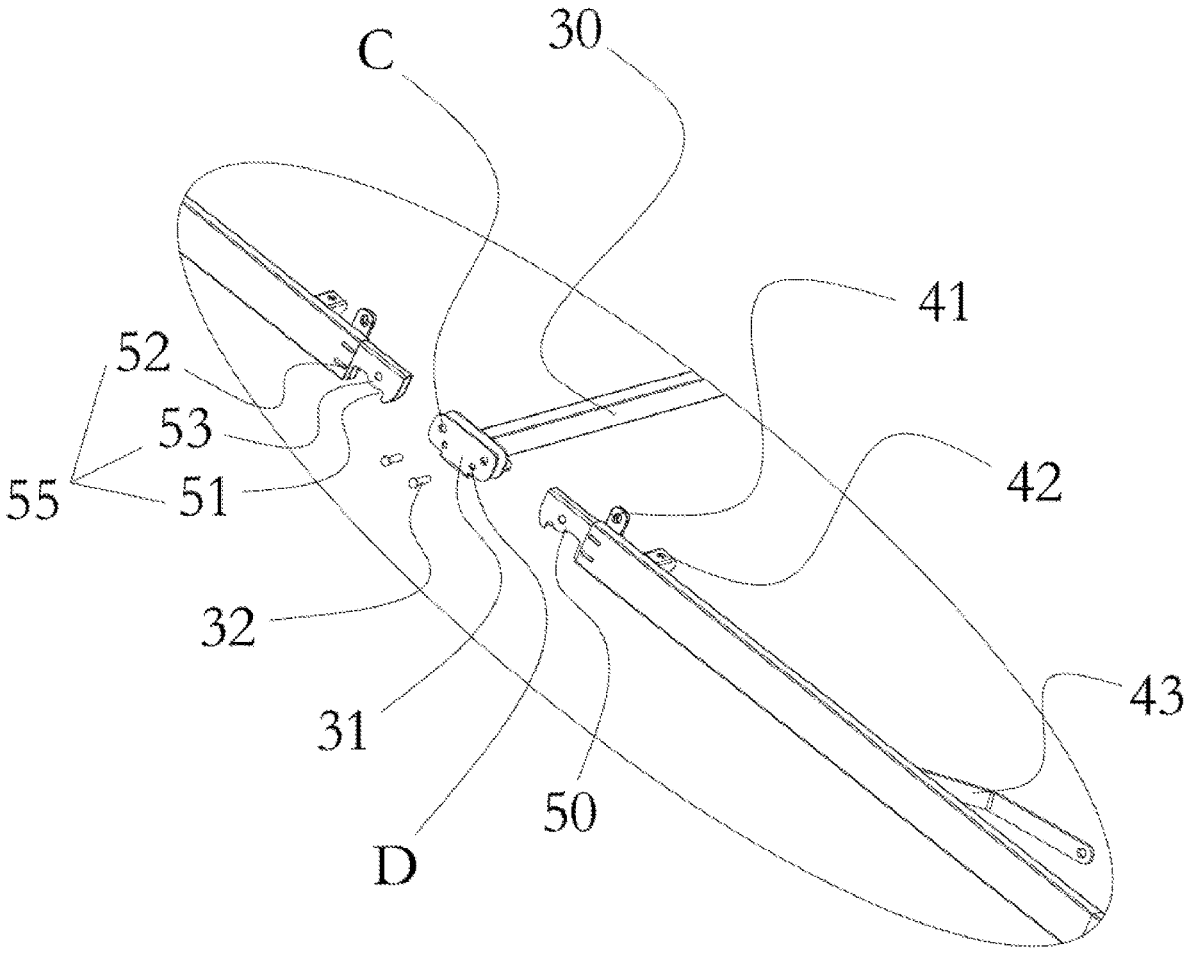
FIG. 7 is an enlarged view of the area A of the present invention.

Further, the clamping member (31) is provided at both ends of the fixing rod (30). The support frame (13) is provided with the matching member (50), which is matched with the clamping member (31). The clamping member (31) and the matching member (50) are hinged by a fastener. In FIG. 7, the position indicated by C is the hinge point of the fastener. In the embodiment of the present invention, the fastener is a rivet, or the like.

Figure 8:
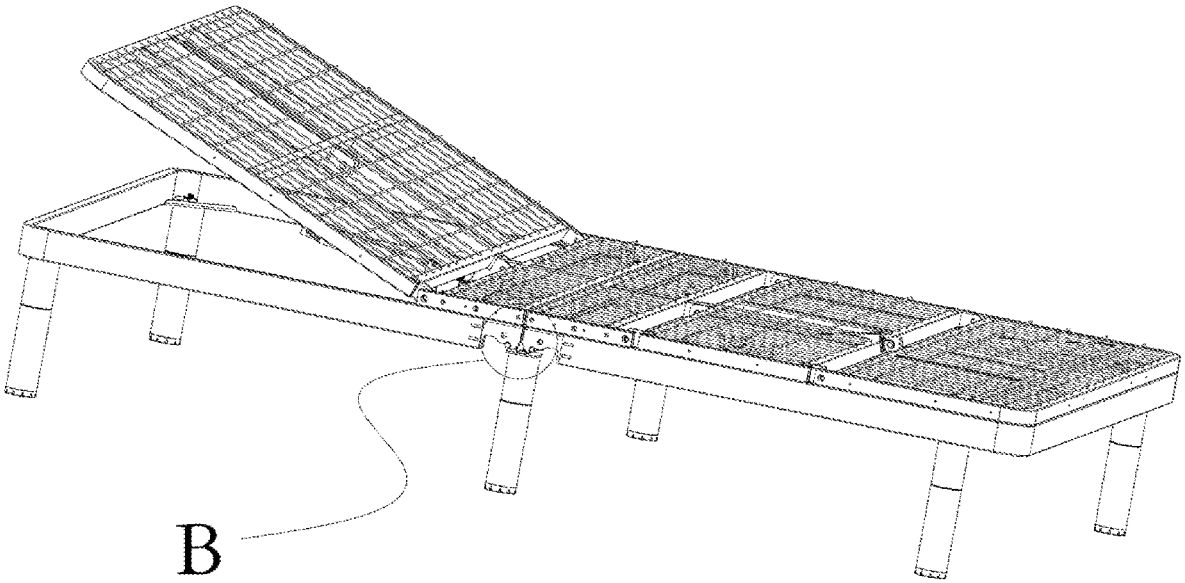
FIG. 8 is a schematic diagram showing the fit between the clamping member and the matching member of the present invention.
Figure 9:
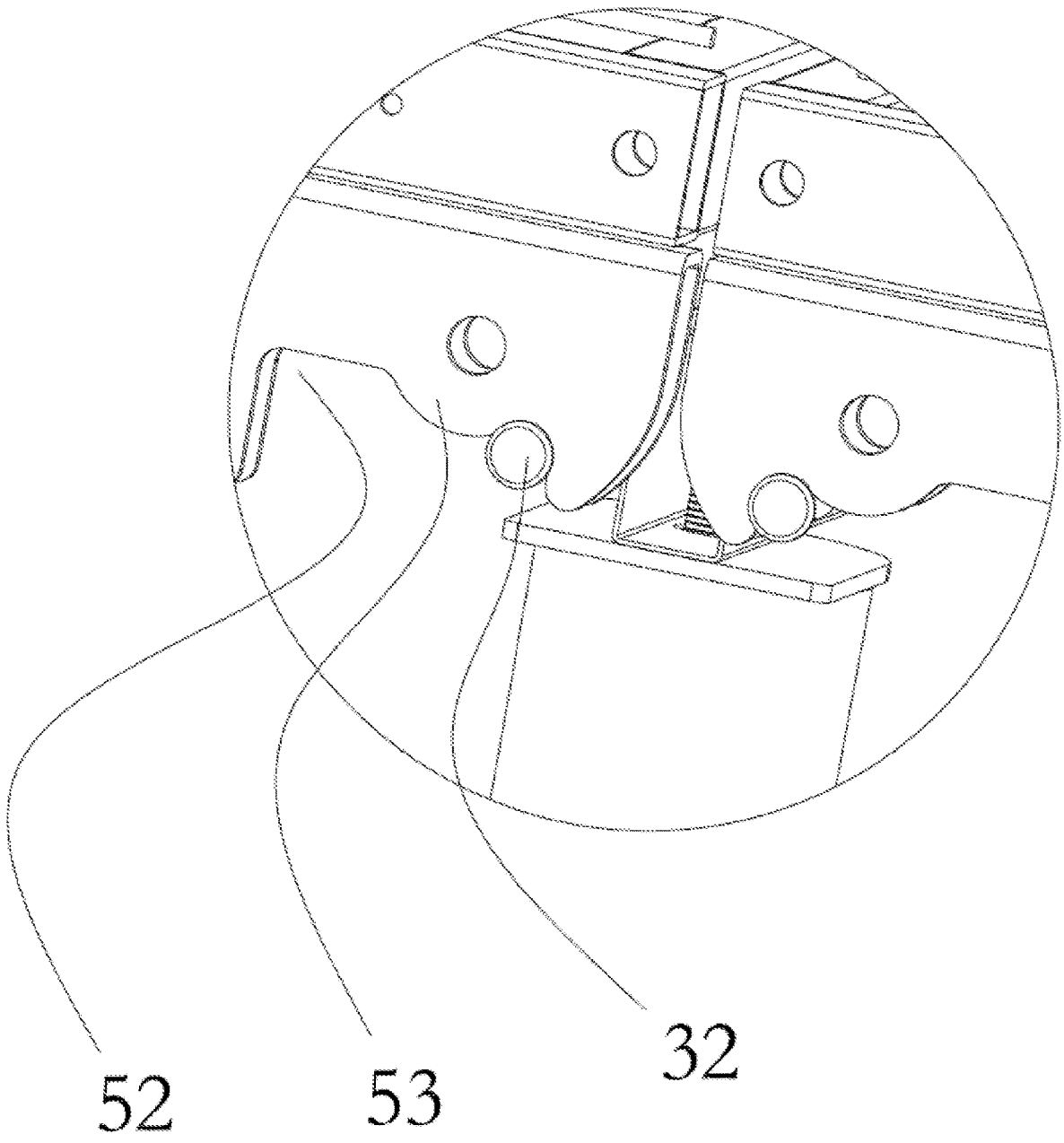
FIG. 9 is an enlarged view of the area B of the present invention.

Further, the clamping member (31) is provided with the positioning column (32). In FIG. 7, the positioning column (32) is arranged at the position D. The matching member (50) is provided with the arc-shaped groove (55) that is matched with the positioning column (32). The arc-shaped groove (55) includes the first notch (51) and the second notch (52). The first notch (51) is configured to position the clamping member (31) through the positioning column (32), and the second notch (52) is configured to avoid jamming in the course of folding the bedstead unit (10). The arc-shaped protrusion (53) is provided between the first notch (51) and the second notch (52). The arc-shaped groove (55) is arranged so that the bedstead units (10) at both sides of the fixing rod (30) can be seamlessly attached to each other by a relatively short rotational distance. Specifically, the side end surface of the first notch (51) is a vertical surface. The side end surface of the second notch (52) and the matching surface of the second notch (52) are straight surfaces. The first notch (51) and the second notch (52) are designed to avoid jamming when the bedstead unit (10) is rotated and folded around the fixing rod (30), so that the bedstead units (10) at both sides of the fixing rod (30) can be seamlessly attached to each other, as shown in FIG. 4. In use, the support frame (13) is unfolded, the positioning column (32) is clamped in the first notch (51) for positioning, as shown in FIG. 8 or FIG. 9. In the folded state, the bedstead units (10) at both sides of the fixing rod (30) are folded into one piece, and the positioning column (32) is clamped in the second notch (52). During the folding process, the arc-shaped protrusion (53) provided on the matching member (50) allows the second notch (52) to slide into and fit into the positioning column (32).

During use, users can regulate and control the motor (20) by a control device, so that the first bedstead unit (11) can be tilted as a backrest or a footrest, and can also be folded integrally when the bed board (14) is horizontal, thus reducing the occupation of space.

The above description shows and describes the preferred embodiments of the present invention. As mentioned above, it should be understood that the present invention is not limited to the form disclosed herein, and should not be construed as an exclusion from other embodiments, and can be used in various other combinations, modifications, and environments, and can be modified within the scope of the present invention described herein according to the above teachings or technologies or knowledge in the related field. Modifications and changes made by those skilled in the art without departing from the spirit and scope of the present invention shall fall within the scope of protection of the appended claims of the present invention.

What is claimed is:

1. A bed structure, comprising:

a bedstead;

wherein the bedstead is formed by bedstead units; the bedstead units are symmetrically arranged with respect to a central axis of the bedstead; and the bedstead units are arranged at both sides of the central axis of the bedstead and are hinged by a fixing rod, and each of two ends of the fixing rod is provided with a clamping member; each bedstead unit of the bedstead is provided with a matching member, wherein the matching member is connected to the clamping member, and the clamping member and the matching member are hinged by a fastener, and the clamping member is provided with a positioning column; the matching member is provided with an arc-shaped groove, wherein the arc-shaped groove is matched with the positioning column; the arc-shaped groove comprises a first notch and a second notch; and an arc-shaped protrusion is provided between the first notch and second notch; and wherein during the positioning column is configured to slide over the arc-shaped protrusion between the first notch and the second notch during a folding or unfolding.

2. The bed structure according to claim 1, wherein, a side end surface of the first notch is a vertical surface; and a side end surface of the second notch and a matching surface of the second notch are both straight surfaces.

3. The bed structure according to claim 2, wherein, each bedstead unit comprises a first bedstead unit and a second bedstead unit; the first bedstead unit is hinged to the second bedstead unit; and a motor is provided between the first bedstead unit and the second bedstead unit.

4. The bed structure according to claim 3, wherein, each bedstead unit comprises a support frame and a bed board; and the bed board of the second bedstead unit is fixedly connected to the support frame.

5. The bed structure according to claim 4, wherein, the bed board comprises outer frames and a support bar, wherein the support bar is arranged between the outer frames.

6. The bed structure according to claim 5, wherein, the support frame is provided with a first fixing member, wherein the first fixing member is fixed to the outer frames of the second bedstead unit.

7. The bed structure according to claim 5, wherein, the support frame is provided with a second fixing member, wherein the second fixing member is fixed to the support bar of the second bedstead unit.

8. The bed structure according to claim 5, wherein, a fixed connecting rod is provided between the support frame and the first bedstead unit.

* * * * *